United States Patent [19]

Kosono et al.

[11] 4,135,763

[45] Jan. 23, 1979

[54] WHEELS FOR ROLLER SKATES AND THE LIKE

[76] Inventors: Kazuhiro Kosono; Yasukazu Kosono, both of No. 9-1, Asakusa 7-chome, Taito-ku, Tokyo, Japan

[21] Appl. No.: 792,287

[22] Filed: Apr. 29, 1977

[30] Foreign Application Priority Data

Jun. 16, 1976 [JP] Japan ..... 51-78816[U]

[51] Int. Cl.[2] ..... A63C 17/22

[52] U.S. Cl. ..... 301/5.7; 308/184 A

[58] Field of Search ..... 301/5.7, 5.3, 63 PW; 152/DIG. 18, 323; 308/191, 184 R, 189 A, 176; 16/46

[56] References Cited

U.S. PATENT DOCUMENTS

| | | | |
|---|---|---|---|
| 2,105,354 | 1/1938 | Hoerle | 301/5.7 X |
| 3,776,337 | 12/1973 | Yoshizawa | 308/189 A X |
| 3,895,844 | 7/1975 | Merbler | 301/63 PW X |
| 3,992,025 | 11/1976 | Amelio | 301/5.7 X |
| 4,040,670 | 8/1977 | Williams | 301/5.3 |

FOREIGN PATENT DOCUMENTS

| | | | |
|---|---|---|---|
| 686516 | 1/1940 | Fed. Rep. of Germany | 301/5.7 |
| 693219 | 6/1953 | United Kingdom | 301/5.7 |

*Primary Examiner*—Stanley H. Tollberg
*Assistant Examiner*—Charles A. Marmor
*Attorney, Agent, or Firm*—William Anthony Drucker

[57] ABSTRACT

The wheels for roller skates and the like in accordance with the present invention comprise wheel bodies which have sockets provided at right and left ends of the wheel bodies and communicated through center holes with a diameter smaller than that of the sockets, two ball bearings mounted on the wheel bodies and elastic pipes inserted into the center holes, wherein two ball bearings are made with a construction in which steel balls are provided between the inner ring provided with a flange on its outer periphery and the outer ring provided with a flange on its inner periphery and these flanges are concentrically fitted in opposed position and mounted onto the outer peripheries of the flanges of the outer and inner rings, and the ends of a hub of the inner ring is fitted into the right and left sockets of the wheel bodies while being kept contact with the ends of the elastic pipes, thereby the wheels are suited to prevent backlash due to wear and tear of steel balls and outer and inner rings resulting from any suddenly varying excessive and heavy load such as, for example, a force in the direction of thrust.

5 Claims, 4 Drawing Figures

WHEELS FOR ROLLER SKATES AND THE LIKE

BACKGROUND OF THE INVENTION

The wheels of roller skates are often provided with ordinary ball bearings that are utilized as mechanical elements for torque transmitting mechanisms. However, since steel balls are fitted or received in shallow grooves, heavy and suddenly changing loads cannot be received, which makes the wheels and their bearings prone to damage in a short period of use.

DESCRIPTION OF PRIOR ART

When ordinary ball bearings with shallow grooves employed in the rotary part of the torque transmitting mechanism are used for wheels for roller skates, board skates and the like, such ball bearings are weak against an instantaneous, complicatedly varying excessive load applied in the direction of thrust. Since two opposing ball bearings are provided independent of the wheels and fine adjustment of the members forming the steel ball retainer is impossible, the steel balls come off from the groove to result in backlash of the wheels when the lock nuts of the wheels are excessively tightened. Moreover, the steel balls which have worn may come out from the clearance of the flanges of the nuts which are square in shape, thus causing a dangerous accident.

SUMMARY OF THE INVENTION

The first object of the present invention is to provide wheels which permit fine adjustment of the members which form the steel ball retainer, prevent the steel balls from coming off even under severe operating condition, and make sure smooth rotation.

The second object of the invention is to provide wheels which are durable against an excessive load and a complicatedly varying instantaneous force.

The third object of the invention is to provide wheels which permit easy handling and easy assembly of parts with rigidity and high accuracy and easy maintenance and disassembly.

BRIEF DESCRIPTION OF THE DRAWINGS

The present invention is illustrated in detail by the accompanying drawings whereof.

DETAILED DESCRIPTION OF THE INVENTION

Figure 1:
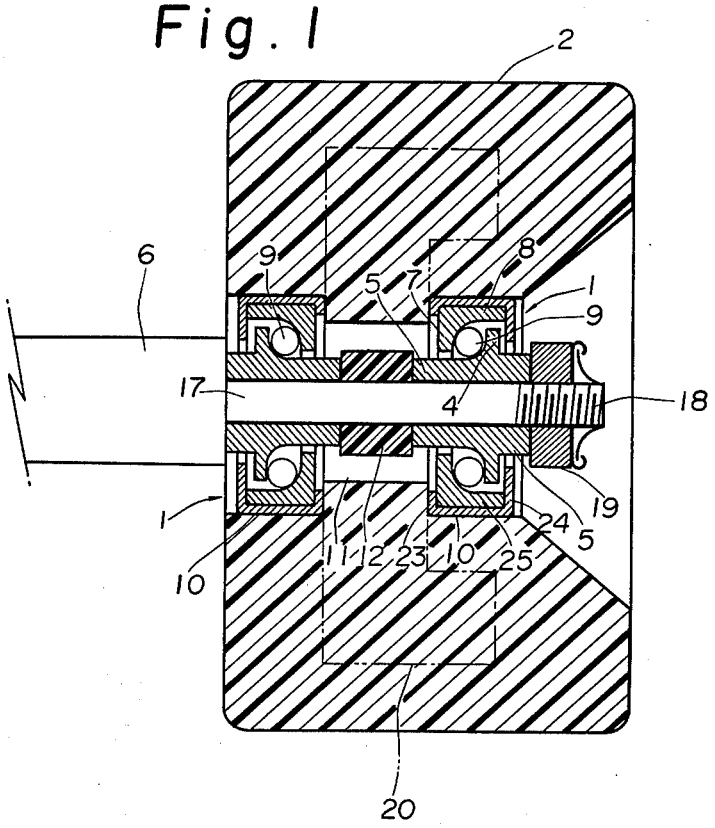
FIG. 1 is a sectional view of the wheel in accordance with the present invention.
Figure 2:
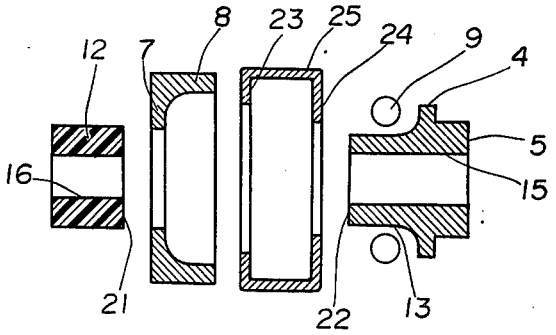
FIG. 2 is a sectional view illustrating a disassembled state of a ball bearing to be used in the wheel according to the invention.
Figure 3:
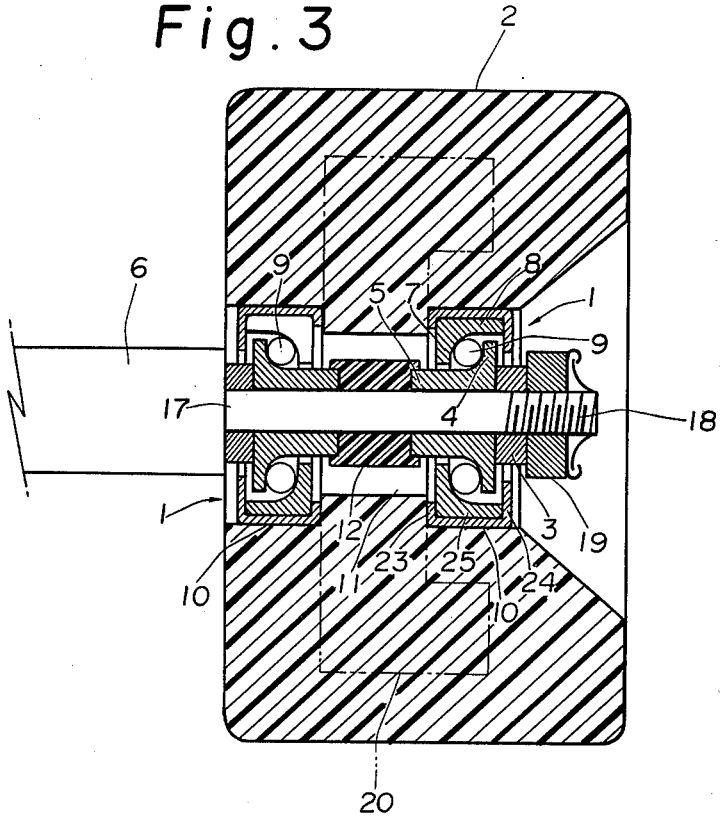
FIG. 3 is a sectional view of the wheel illustrating another embodiment of the invention in which a rigid core member is incorporated in the wheel body and an intervening member is provided between the inner ring of the ball bearing and the lock nut and between the inner ring and the track.
Figure 4:
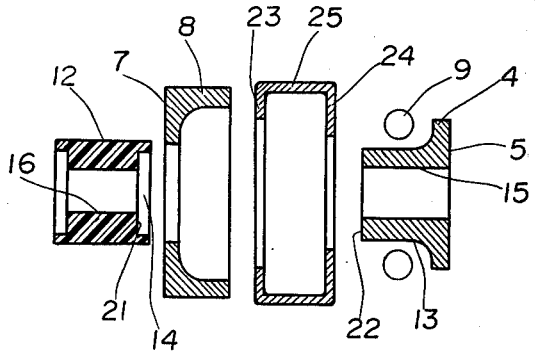
FIG. 4 is a sectional view illustrating the disassembled state of the ball bearing shown in FIG. 3.

The drawings show an embodiment according to the present invention and, referring to FIG. 1, there are shown the ball bearing 1 and the wheel body 2. The ball bearing 1 is assembled such that the inner ring 5 provided with the flange 4 on its outer periphery is concentrically fitted to the outer ring 8 provided with the flange 7 on its inner periphery while a plurality of steel balls are arranged between the flanges 4 and 7 and the flange 4 of the inner ring 5 is opposed to the flange 7 of the outer ring 8, and the annular cover 25 with a ]-shaped section in which the right and left folded edges 23 and 24 are positioned opposing to each other is mounted on the outer periphery of the outer ring 8 by forcing the folded edge 23 to contact with the outside surface of the flange 7 of the outer ring 8 and positioning the folded edge 24 at the outside surface of the flange 4 of the inner ring 5 which is fitted into the outer ring 8. On the other hand, the wheel body 2 is made up with the sockets 10 and 10 which are disposed at the right and left ends of the wheel body and communicated through the center hole 11 with a smaller diameter than that of the socket. The center hole 11 has an inside diameter substantially equal to the outside diameter of the inner ring 5 of the ball bearing 1 and the elastic pipe 12 made of a plastic material with suitable elasticity and large force of restoration such as of nylon, urethane, polyurethane or a mixture of urethane and polycarbonate is inserted into the center hole 11. The socket 10 has an outside diameter equal to the outside diameter of the annular cover 25 of the ball bearing. The ball bearing 1 is fitted into the socket 10 so that the flange 4 of the inner ring 5 is positioned at the outer side and the hub 13 opposite to the flange 4 is positioned at the inner side and the hub 13 is fitted to the end of the elastic pipe 12 for simple contact as shown in FIGS. 1 and 2 or fitted into the fitting hole 14 provided on the end of the elastic pipe 12 as shown in FIGS. 3 and 4 and the end 22 of the hub 13 is forced to contact with the end 21 of the elastic pipe 12, thus the wheels according to the invention being assembled. The elastic pipe 12 controls elastically the distance between the inner rings 5 and 5 of the right and left ball bearings 1 and 1 in the assembled state of the wheel of the invention, permitting slight adjustment of the inner ring 5 in the axial direction in reference to the outer ring 8.

The wheels constructed as described above are fixedly mounted on the axle 17, which is inserted into the axle hole 15 of the inner ring 5 of the ball bearing 1 and the axle hole 16 of the elastic pipe 12, by clamping the lock nuts 19 such as a detent nut to the threads 18 provided on the extreme ends of the axle 17 and are used as usual. The wheel body 2 is generally made of a plastic material such as nylon, urethane, polyurethane or a mixture of urethane and polycarbonate (other materials are also available). When the wheel body 2 is made of such material, the core member 20 made of polycarbonate with a high rigidity is generally built in the part of the center hole 11 to maintain a proper distance between the outer rings 8 and 8 of two ball bearings. The fitting of the hub 13 of the inner ring 5 into the fitting hole 14 of the elastic pipe 12 shown in FIGS. 3 and 4 is effective to maintain proper relative positions of these parts 12 and 5 and prevent them from being disordered but the type of fitting of the elastic pipe 12 and the inner ring 5 can be reversed. Needless to say, the clamping by the lock nuts 19 without providing the fitting hole in the elastic pipe as shown in FIG. 1 also ensures the same effect. The annular cover 25 is generally attached to the outer ring 8 by means of the drawing process. Referring to FIG. 3, there are shown the intervening member 3 provided between the inner ring 5 of the ball bearing 1 and the nut 19 as well as between the inner ring 5 and the track 6 (described in the following) to which the axle 17 is attached. This prevents the annular cover 25 from deformation due to depression against the inner ring 5 by the nut 19 and the track 6 and hindering smooth rotation of the ball bearing.

The wheels according to the invention are constructed as described above so that the elastic pipe 12 is disposed between the inner rings 5 and 5 of the right and left ball bearings 1 and 1 and compressed to allow the inner rings 5 and 5 to move toward the inside when the lock nut is tightened and reduce the distance between the flange 4 of the inner ring 5 and the flange 7 of the outer ring 8, thus preventing the wheels from playing due to wear of the steel balls 9, outer ring 8 and inner ring 5. Two ball bearings 1 and 1 assembled by opposing the flange 4 of the inner ring 5 to the flange 7 of the outer ring 8 are mounted back to back, that is, symmetrically on the wheel body 2 and the right side ball bearing 1 (flanges 4 and 7) bears the right side load to the wheel body 2 and the left side ball bearing 1 bears the left side load and therefore the wheel according to the invention can withstand an instantaneously varying excessive load and guarantee smooth rotation even under severe operating conditions. Moreover, the elastic pipe 12 acts to prevent the follow-up rotation of the inner ring 5 which takes place due to rotation of the outer ring 8 and therefore the lock nut 19 is prevented from loosening. The annular cover 25 is mounted on the outer periphery of the outer ring 8 and the outer ring, inner ring 5 and steel balls 9 are assembled together and therefore the wheels of the invention have great practical advantages such as easy maintenance, assembly and disassembly without any loss of the original accuracy, unlike the conventional ball bearings which are assembled with separate parts.

What is claimed is:

1. In a wheel for roller skates and the like, of the kind including:

(i) a wheel body having first and second coaxial sockets each opening at a respective axial end face of the body, and a coaxial centre hole of smaller diameter opening at each end into a respective one of said sockets, (ii) first and second ball-race bearings each including:

(a) an inner ring having an external flange on its outer periphery, (b) an outer ring disposed concentrically about said inner ring and having an internal flange on its inner periphery, (c) a plurality of balls disposed between and contacting said internal and external flanges, (d) an annular cover having two axially-spaced inturned radial edge portions, said cover being disposed about said outer ring with a first of said inturned edge portions abutting the internal flange of the outer ring, and with the second of said inturned edge portions axially spaced from said external flange of said inner ring, the improvement that:

(1) an elastic pipe is disposed in said centre hole, (2) said inner rings each include a hub extending axially through the internal flange of the outer ring, and (3) said first and second ball race bearings are disposed respectively in said first and second coaxial sockets with said hubs each abutting a respective axial end of said elastic pipe.

2. In combination, a wheel as claimed in claim 1, a track, an axle extending from said track, and an intervening member carried on said axle and abutting said track, said wheel being carried on said axle with one of said inner rings abutting said intervening member.

3. In combination, a wheel as claimed in claim 1, a track, an axle extending from said track and having a threaded portion at its end remote from said track, a first intervening member carried on said axle and abutting said track, said wheel being carried on said axle with said inner ring of a first bearing abutting said first intervening member, a second intervening member carried on said axle and abutting said inner ring of said second bearing, and a nut engaged on the threaded portion of said axle and abutting said second intervening member.

4. A wheel, as claimed in claim 1, wherein said wheel body is made of an elastic material selected from the group consisting of nylon, urethane, polyurethane, and mixtures of urethane and polycarbonate.

5. A wheel, as claimed in claim 1, wherein said wheel body incorporates a core member of greater rigidity than the remainder of the wheel body, said coaxial centre hole being formed in said core member.

* * * * *